US007770832B2

(12) United States Patent
Beukelman et al.

(10) Patent No.: US 7,770,832 B2
(45) Date of Patent: Aug. 10, 2010

(54) CHIPPER DEVICE AND METHOD FOR CHIPPING METAL INGOTS

(75) Inventors: David Beukelman, Watervliet, MI (US); Richard Henderson, Galien, MI (US); Christopher Kiggins, Niles, MI (US); Martin Pingel, Niles, MI (US); Ken Ward, Three Oaks, MI (US)

(73) Assignee: Metal Processors Inc., Stevensville, MI (US)

( * ) Notice: Subject to any disclaimer, the term of this patent is extended or adjusted under 35 U.S.C. 154(b) by 542 days.

(21) Appl. No.: 11/745,517

(22) Filed: May 8, 2007

(65) Prior Publication Data

US 2008/0277510 A1 Nov. 13, 2008

(51) Int. Cl.

| | |
|---|---|
| ***B02C 7/00*** | (2006.01) |
| ***B02C 7/12*** | (2006.01) |
| ***B02C 13/28*** | (2006.01) |
| ***B02C 1/08*** | (2006.01) |
| ***B02C 17/20*** | (2006.01) |

(52) U.S. Cl. ..... 241/281; 241/282

(58) Field of Classification Search ..... 241/281, 241/282, 34, 100; 144/172

See application file for complete search history.

(56) References Cited

U.S. PATENT DOCUMENTS

| | | | | | |
|---|---|---|---|---|---|
| 1,341,156 | A | * | 5/1920 | Schaanning | 241/151 |
| 1,626,015 | A | * | 4/1927 | Ullgren | 241/282 |
| 1,736,858 | A | * | 11/1929 | Merkel et al. | 241/281 |
| 2,784,753 | A | * | 3/1957 | Kliem et al. | 144/42 |
| 3,112,080 | A | * | 11/1963 | Wagner | 241/280 |
| 3,160,351 | A | * | 12/1964 | Shelton, Jr. | 241/34 |
| 3,361,167 | A | | 1/1968 | Farnsworth | |
| 3,559,898 | A | | 2/1971 | Rinke | |
| 3,923,256 | A | | 12/1975 | Dorner | |
| 4,771,953 | A | | 9/1988 | Morey | |
| 4,967,969 | A | | 11/1990 | Griffith, III | |
| 6,826,967 | B2 | | 12/2004 | Missotten et al. | |
| 7,068,177 | B2 | | 6/2006 | Tice | |

* cited by examiner

*Primary Examiner*—Bena Miller
(74) *Attorney, Agent, or Firm*—Barnes & Thornburg LLP

(57) ABSTRACT

A chipper device for chipping one or more metal ingots. The chipper device includes a cutter head and a guide mechanism associated with the cutter head. The guide mechanism includes a chute having a passageway. A feed mechanism is adapted to move one or more ingots sequentially through the passageway of the chute into engagement with the cutter head, whereby the cutter head chips the ingots into a plurality of particles.

19 Claims, 18 Drawing Sheets

CHIPPER DEVICE AND METHOD FOR CHIPPING METAL INGOTS

BACKGROUND

The present disclosure is directed to a chipper device for chipping one or more metal ingots into a plurality of particles, and in particular to a chipper device which is adapted to sequentially feed and guide a plurality of ingots, one after another, into engagement with a rotatable cutter head for chipping.

Metal ingots are often used in metal casting processes. The metal ingots are relatively large and are often required to be comminuted into a plurality of smaller pieces or particles in order to be used in a metal casting process. A metal casting process known as Thixomolding is used in the manufacture of high-density complex-shaped components. In Thixomolding chipped metal material is fed through a heated multi-zone barrel that transforms the chipped material into a semi-solid thixotropic state which is then injected into a mold with vacuum assistance. Magnesium alloys are commonly used materials in Thixomolding. The thixotropic, or semi-solid, nature of the heated materials in the Thixomolding process provides microstructure refinement and enhances material properties. Geometries of products cast by Thixomolding can be more intricate with higher densities and a finer detailed finish.

SUMMARY

A chipper device for chipping one or more metal ingots into a plurality of particles. The chipper device includes a cutter head having a plurality of cutting teeth adapted to be rotated about a first axis. A guide mechanism is associated with the cutter head. The guide mechanism includes a chute having a first end, a second end and a passageway having a second axis. The passageway extends from the first end of the chute toward the cutter head such that ingots are adapted to move through the passageway from the first end of the chute toward the cutter head. The guide mechanism includes one or more hold-down mechanisms. Each hold-down mechanism includes an engagement member and a biasing member adapted to bias the engagement member into biased engagement with an ingot in a direction generally transverse to the second axis of the passageway, while allowing the ingot to move parallel to the second axis through the passageway.

A feed mechanism is adapted to move one or more ingots through the passageway of the chute into engagement with the cutter head. The feed mechanism may comprise an actuator having a selectively extendable and retractable ram wherein the ram is adapted to move one or more ingots through the passageway of the chute into sequential engagement with the cutter head. A loading mechanism, such as a conveyor, is adapted to position one or more ingots sequentially in a load area with respect to the chute such that the feed mechanism is adapted to move the ingot toward the cutter head. The chipper device may include a sifting mechanism for sorting the chipped particles by size. The chipper device may include one or more sensors adapted to control operation of the chipper device.

BRIEF DESCRIPTION OF THE DRAWING FIGURES

DETAILED DESCRIPTION

Figure 1:
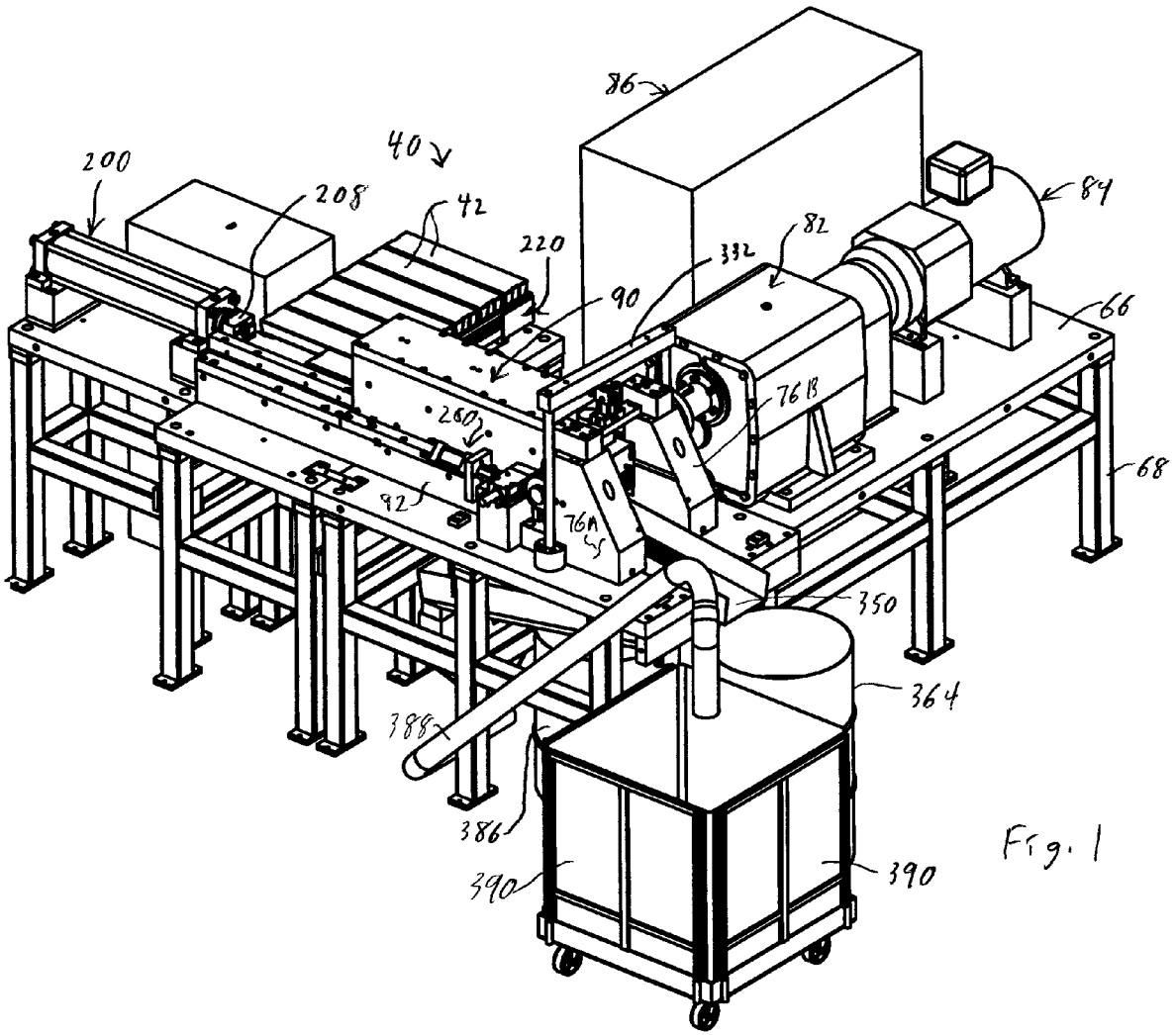
FIG. 1 is a perspective view of one embodiment of the chipper device.
Figure 6:
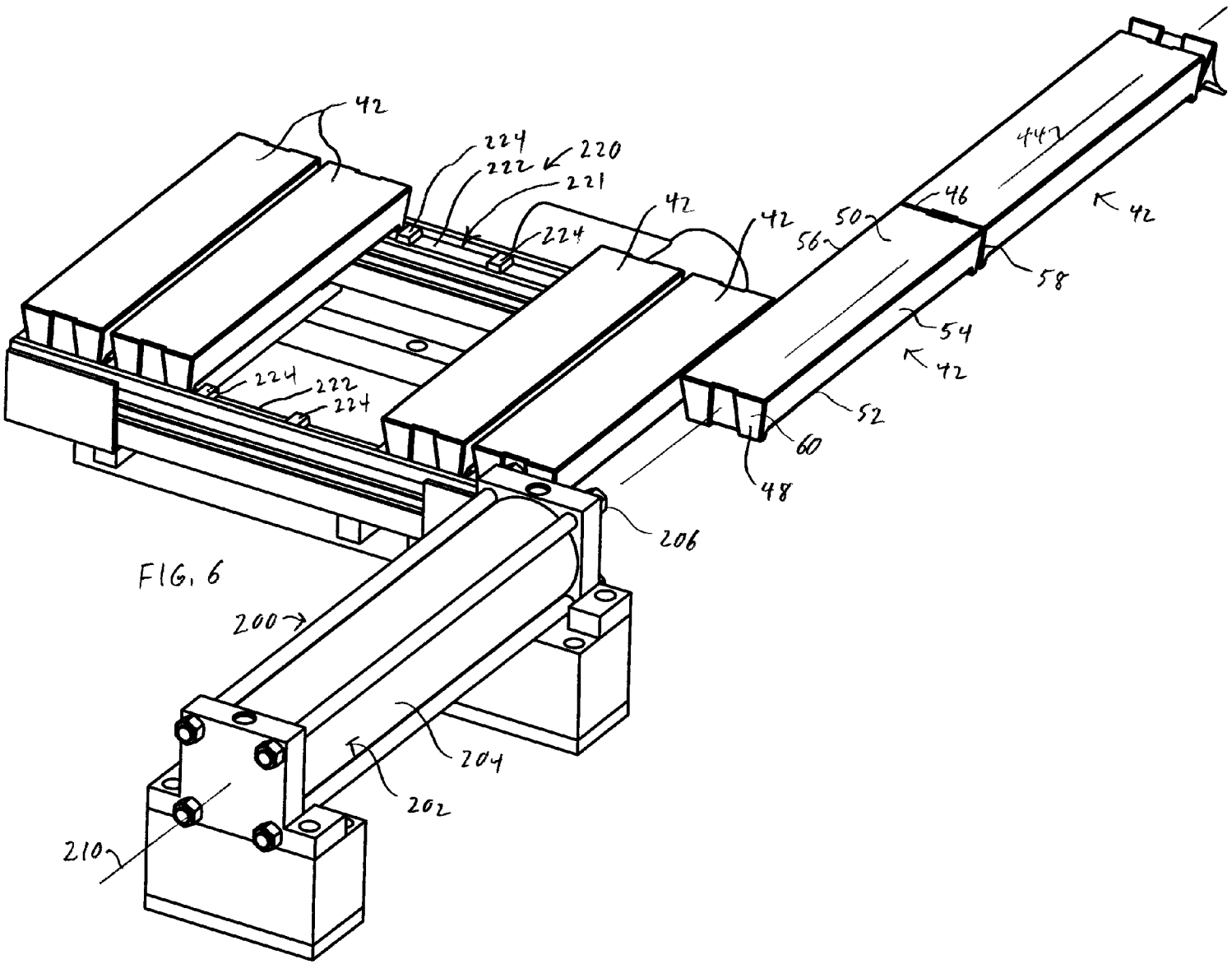
FIG. 6 is a perspective view of the feed mechanism and loading mechanism of the chipper device.
Figure 7:
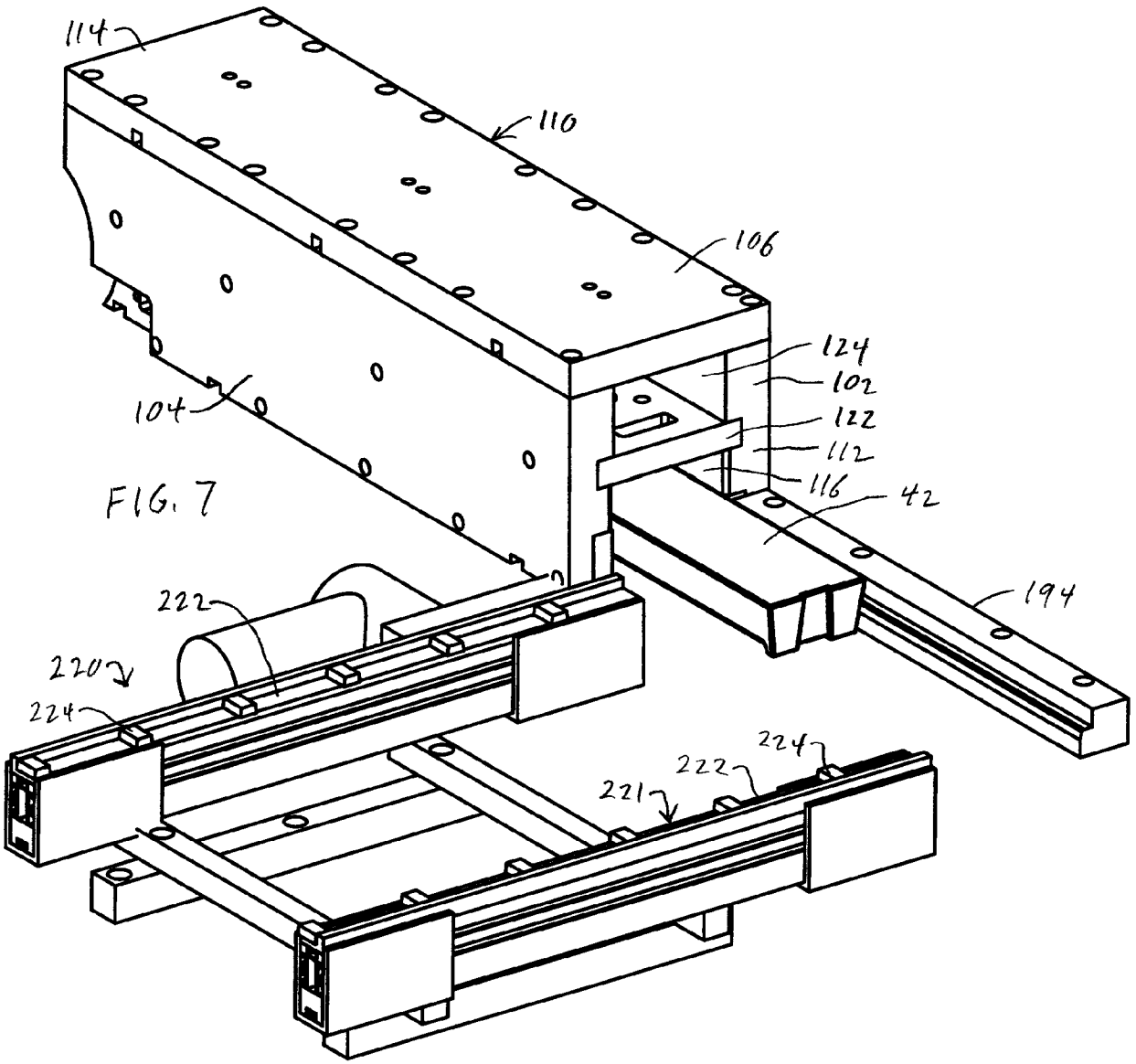
FIG. 7 is a perspective view of the loading mechanism and guide mechanism of the chipper device.

The chipper device 40 as shown in FIG. 1 is adapted to chip one or more metal ingots 42 into a plurality of relatively smaller pieces or particles. As best shown in FIG. 6, each ingot 42 is in the general shape of a rectangular parallelepiped. Each ingot 42 includes a generally linear central longitudinal axis 44 that extends from a first end 46 to a second end 48 of the ingot 42. Each ingot 42 includes a generally planar top wall 50, a generally planar bottom wall 52, a generally planar first side wall 54, a generally planar second side wall 56, a first end wall 58 at the first end 46, and a second end wall 60 at the second end 48. The side walls 54 and 56 are inclined inwardly as they extend from the top wall 50 to the bottom wall 52. Each ingot 42 is approximately twenty-six inches long between the first end wall 58 and second end wall 60, approximately three inches tall between the bottom wall 52 and the top wall 50, and approximately six inches wide between the first and second side walls 54 and 56 at the top wall 50. The ingots 42 are formed of metal, such as for example, magnesium and magnesium alloys. An ingot 42 made of magnesium with the above dimensions weighs approximately twenty-five pounds.

The chipper device 40 includes a platform 66 comprising a plurality of generally planar plates. The platform 66 is rigidly supported in a generally horizontal position above a support surface by one or more stands 68. The height of the platform 66 above the floor is adjustable by the use of leveling screws located at the bottom ends of the legs of the stands 68. The plates of the platform 66 may be removably coupled together to insure proper location of each component of the chipper device 40.

Figure 2:
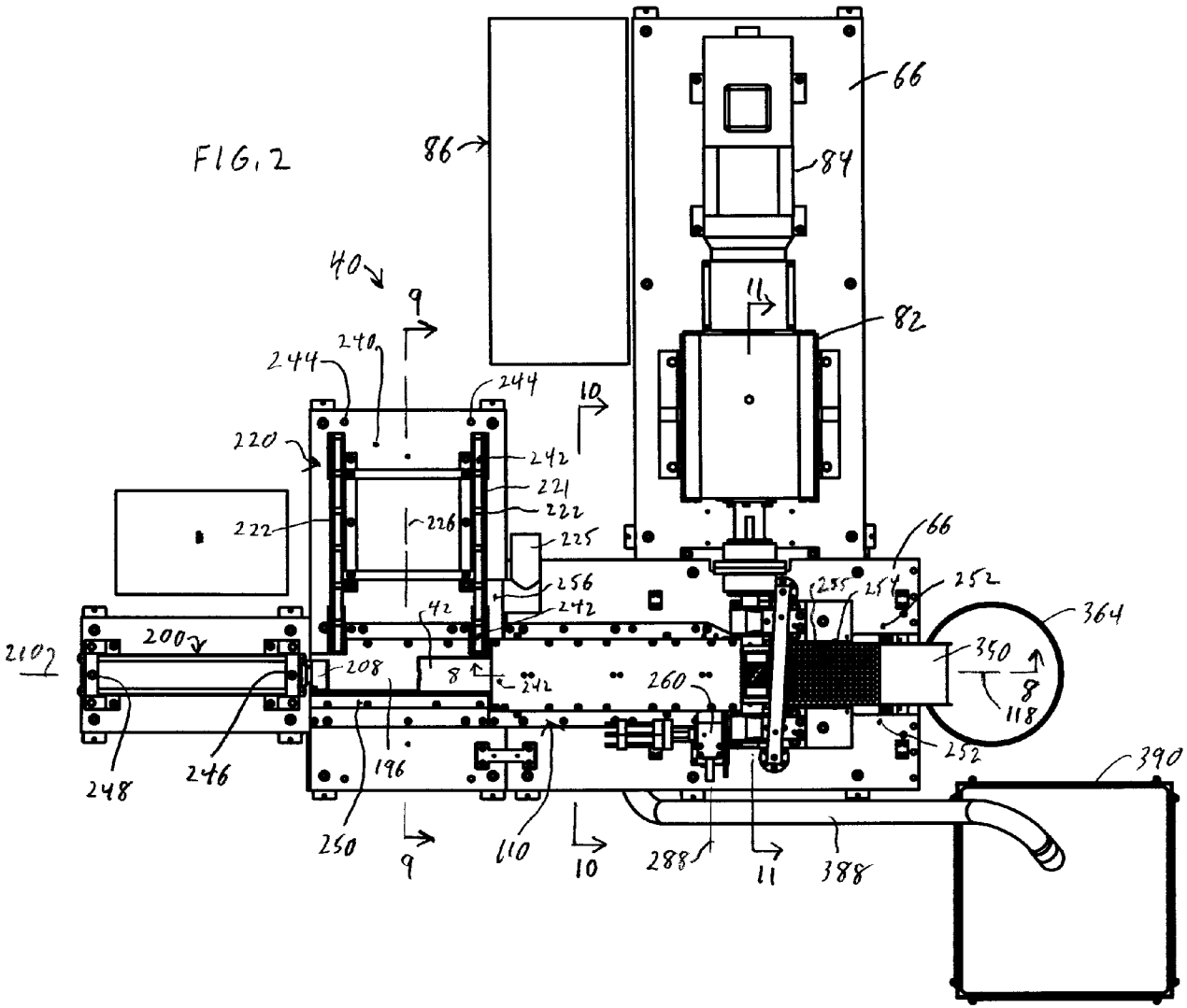
FIG. 2 is a top plan view of the chipper device of FIG. 1.
Figure 3:
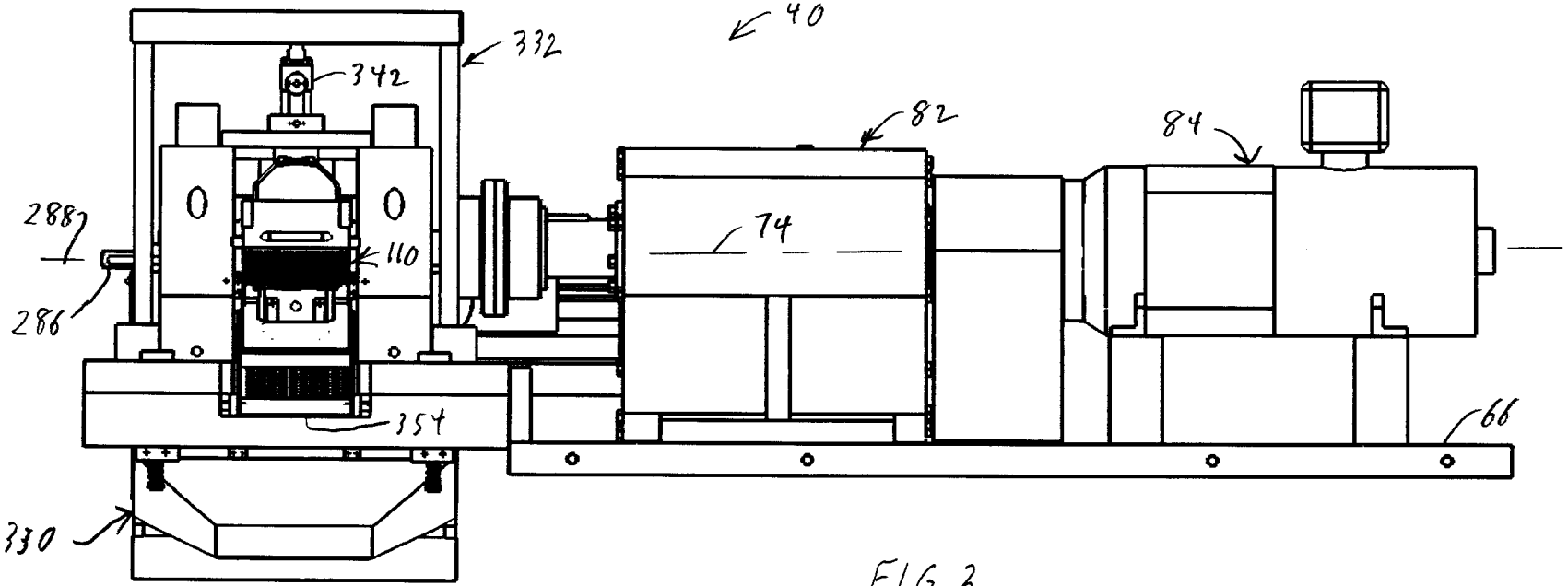
FIG. 3 is a front elevational view of the chipper device.
Figure 4:
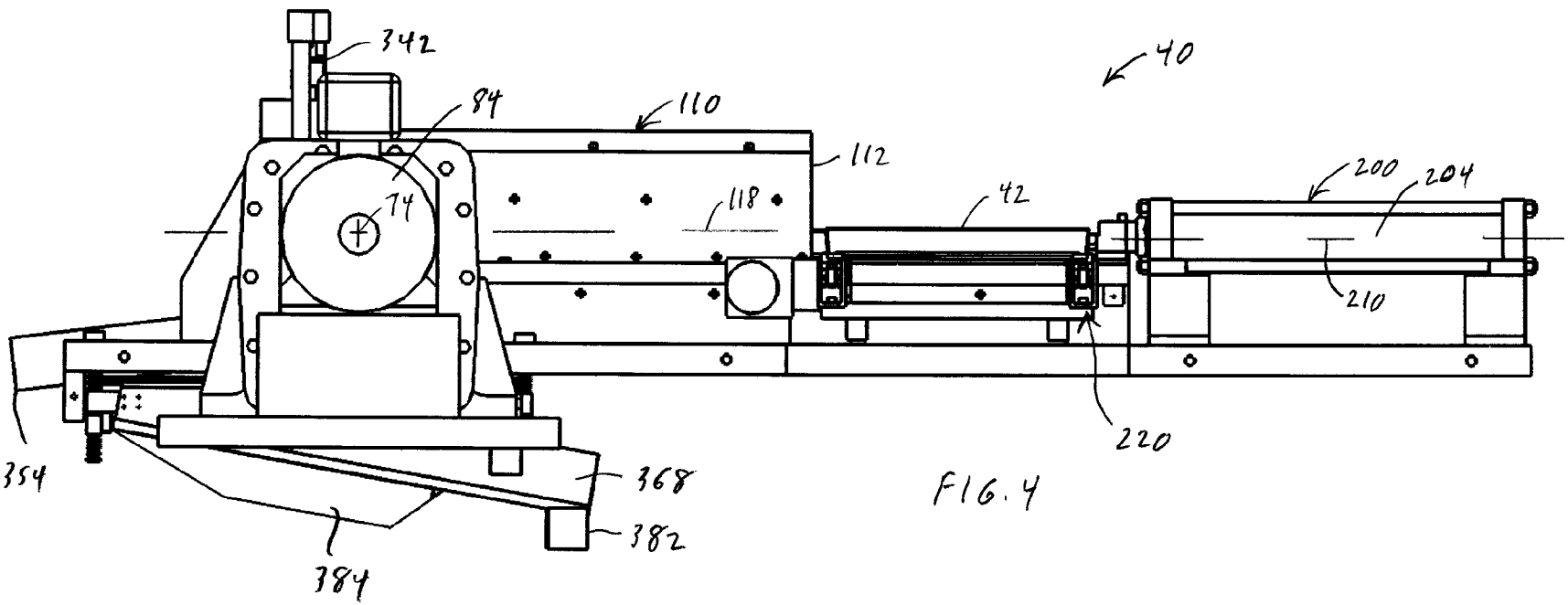
FIG. 4 is a right side elevational view of the chipper device.
Figure 5:
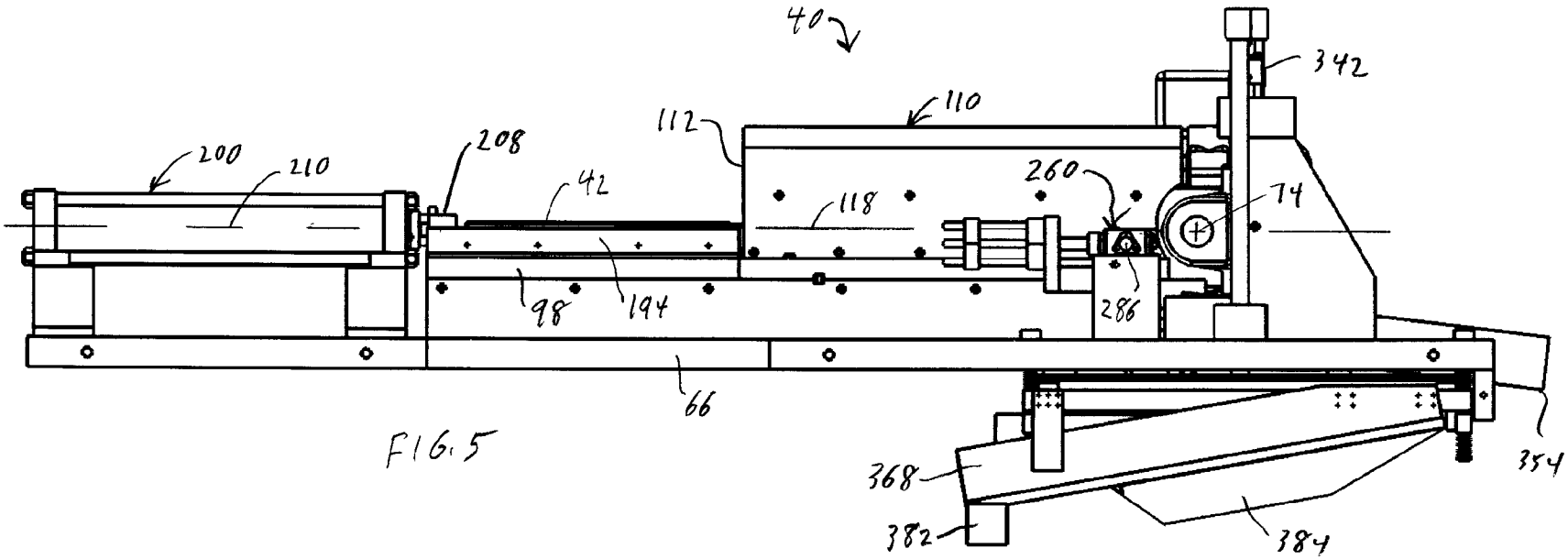
FIG. 5 is a left side elevational view of the chipper device.
Figure 11:
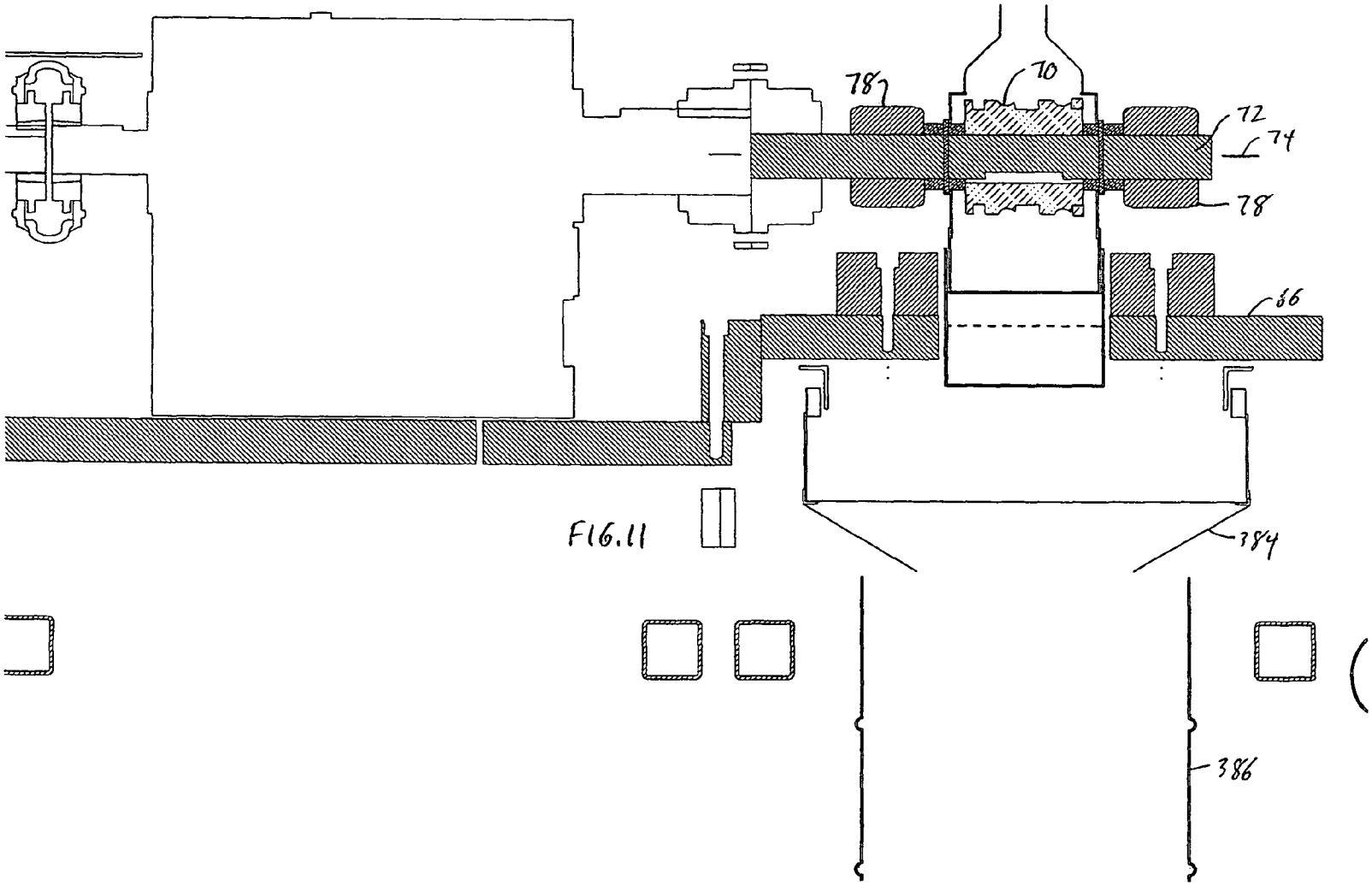
FIG. 11 is a partial cross sectional view taken along line 11-11 of FIG. 2.
Figure 12:
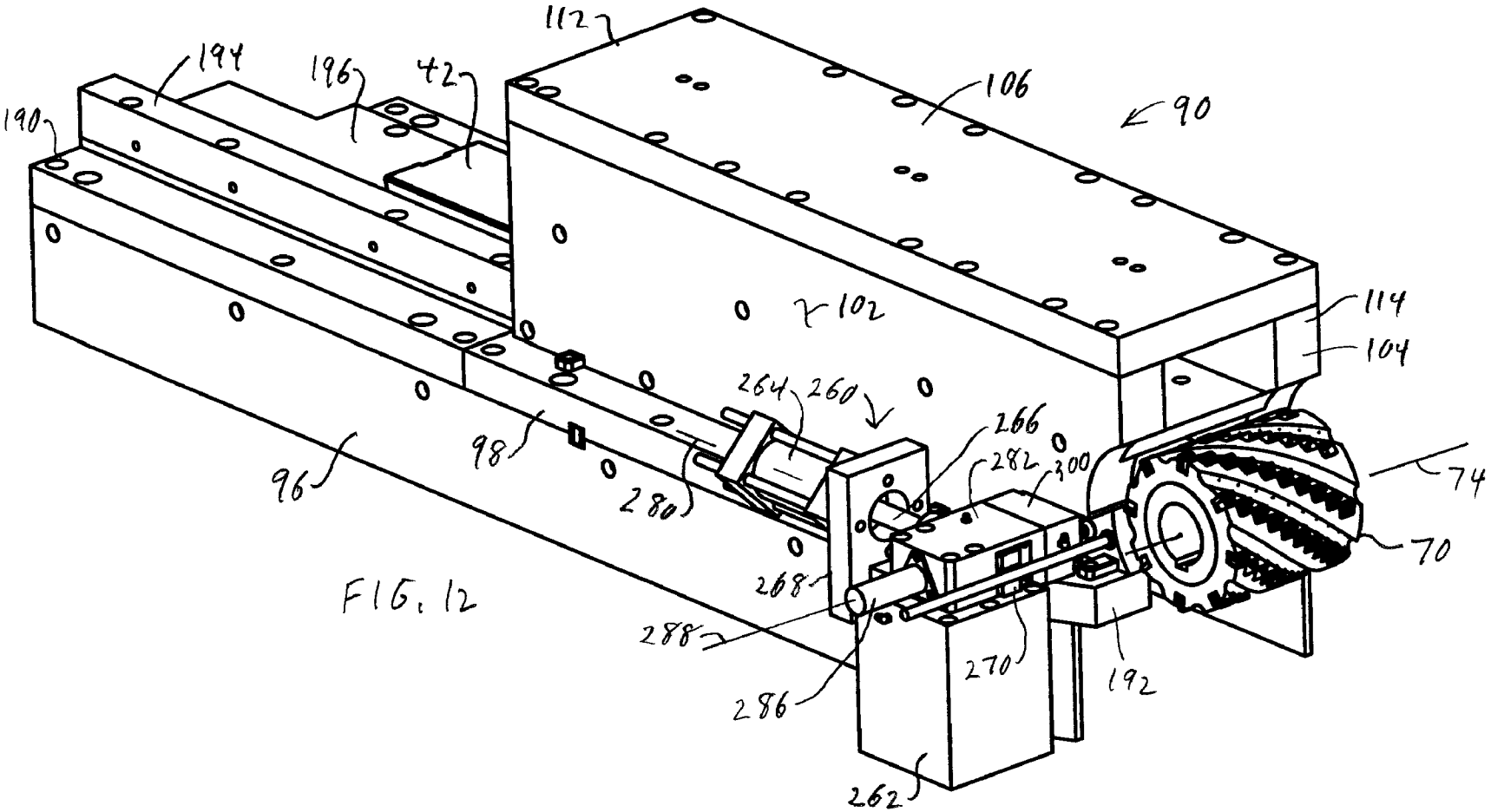
FIG. 12 is a perspective view of the guide mechanism and cutter head.
Figure 13:
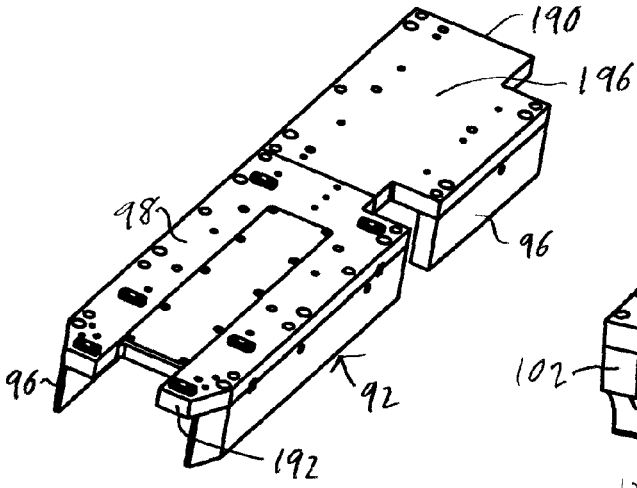
FIG. 13 is a perspective view of the base of the guide mechanism.
Figure 14:
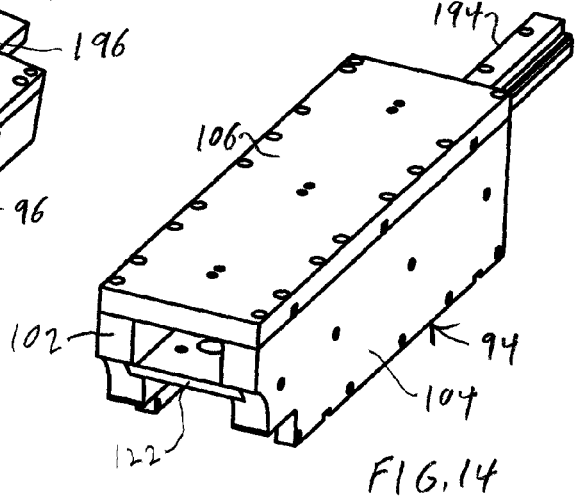
FIG. 14 is a perspective view of the housing of the guide mechanism.

As best shown in FIG. 11, a generally cylindrical cutter head 70 is removably attached to an elongate generally cylindrical shaft 72. The cutter head 70 is removably coupled to the shaft 72 by a key or the like such that the cutter head 70 and shaft 72 conjointly rotate about a generally linear central axis 74 of the shaft 72 and cutter head 70. The cutter head 70 includes a plurality of removable and replaceable cutting teeth. The cutter head 70 and shaft 72 are rotatably attached to spaced apart support members 76A-B by bearings 78. The cutter head 70 is adapted to rotate about the axis 74 in a generally counter-clockwise direction as viewed in FIG. 8. As shown in FIG. 2, an end of the shaft 72 is coupled to the output shaft of a gear reducer 82 with a coupler mechanism. An input shaft of the gear reducer 82 is coupled to the output shaft of a variable speed electric motor 84 by a coupler mechanism. The coupler mechanism between the motor 84 and gear reducer 82 is adapted to relieve shock between the motor 84 and the gear reducer 82. The motor 84 may, for example, be a variable speed seventy-five horsepower motor. The motor 84 is electrically connected to, and is controlled by, a control panel 86. The motor 84 rotates the cutter head 70 about the axis 74 at a desired number of revolutions per minute (RPM) and at a desired torque. The RPM of the cutter head 70 may be varied as desired by the variable speed motor 84. As an example, the cutter head 70 may rotate at approximately sixty RPM with an ingot feed speed of approximately 19.2 inches per minute. The cutter head 70 may be a Model No. 63E6V0818-06 eight inch diameter by eight inch wedge clamp body as manufactured by Seaco Special Tooling. The cutter head 70 and shaft 72 may be easily removed and replaced from the chipper device 40 for servicing and maintenance.

The chipper device 40 includes a guide mechanism 90 attached to the upper surface of the platform 66. The guide mechanism 90 includes a base 92 and a housing 94. The base 92 includes a plurality of upstanding support legs 96 and a base member 98 comprising one or more plates. The legs 96 support the base member 98 spaced above the platform 66. The housing 94 includes a first side wall 102 and a spaced apart and generally parallel second side wall 104. A top wall 106 extends between the top ends of the first and second side walls 102 and 104. The bottom ends of the first and second side walls 102 and 104 are attached to the base member 98 of the base 92. The base 92 and housing 94 form a chute 110. The chute 110 includes the housing 94 and the base member 98 which forms a bottom wall of the chute 110. The chute 110 includes a first end 112 and a second end 114. A passageway 116 extends through the chute 110 from the first end 112 to the second end 114 along a generally linear longitudinal axis 118. The axis 118 is generally perpendicular to the axis 74 of the cutter head 70. The second end 114 of the chute 110 is associated with, and located adjacent to, the cutter head 70 such that the passageway 116 is in communication with the cutter head 70. A collection member 120 is located adjacent and below the cutter head 70 and adjacent the second end 114 of the chute 110. The collection member 120 includes an inlet adapted to receive particles chipped from the ingots 42 by the cutter head 70, and an outlet adapted to dispense the chipped particles into a removable container.

The chute 110 also includes a guide member 122, such as a generally planar plate. The guide member 122 extends between and is coupled to the first side wall 102 and second side wall 104 of the chute 110, and is located between and generally parallel to the top wall 106 and bottom wall 98 of the chute 110. The guide member 122 extends substantially from the first end 112 to the second end 114 of the chute 110. The passageway 116 is located between the guide member 122 and the bottom wall 98. A chamber 124 is located between the guide member 122 and the top wall 106.

Figure 15:
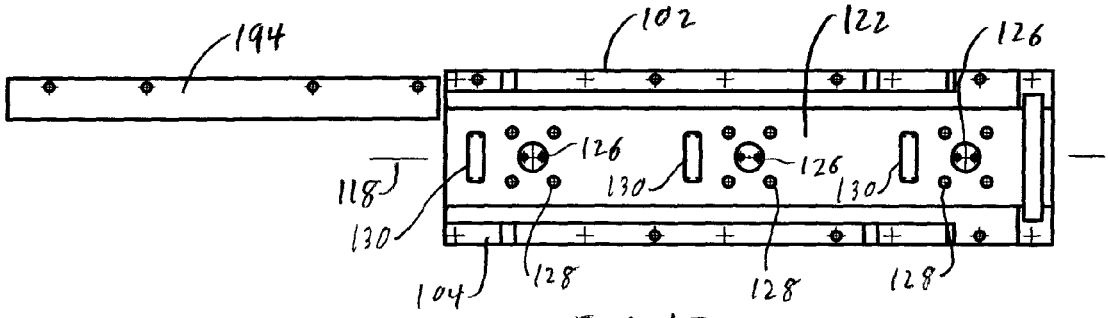
FIG. 15 is a bottom view of the housing of the guide mechanism.
Figure 16:
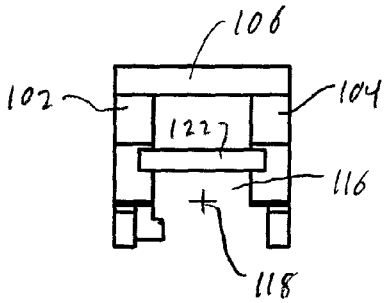
FIG. 16 is an end view of the housing of the guide mechanism.
Figure 17:
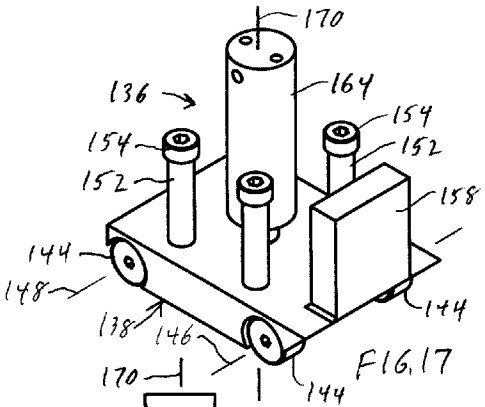
FIG. 17 is a perspective view of a hold-down mechanism of the guide mechanism.
Figure 20:
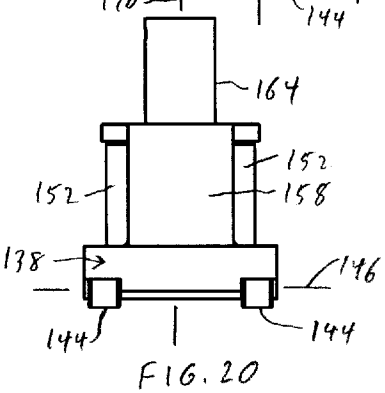
FIG. 20 is a front elevational view of the hold-down mechanism.
Figure 19:
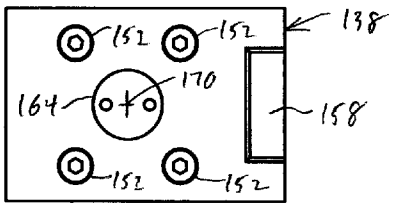
FIG. 19 is a top plan view of the hold-down mechanism.
Figure 18:
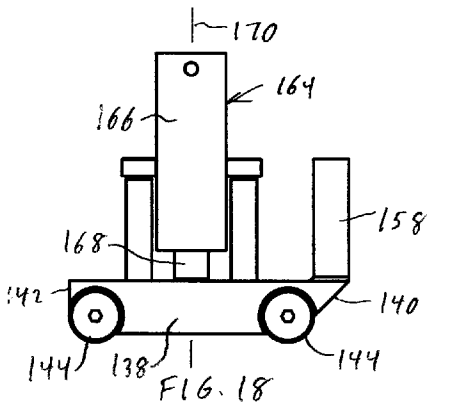
FIG. 18 is a side elevational view of the hold-down mechanism.
Figure 22:
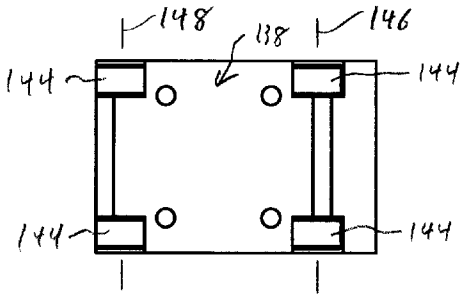
FIG. 22 is a bottom view of the hold-down mechanism.
Figure 21:
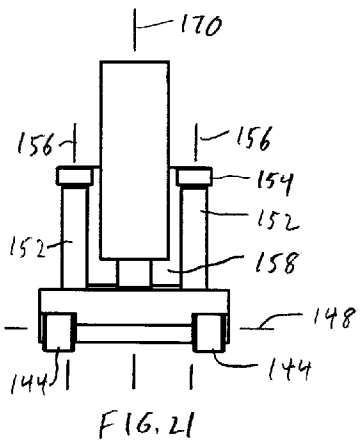
FIG. 21 is a rear elevational view of the hold-down mechanism.

As best shown in FIG. 15, the guide member 122 includes spaced apart generally circular central apertures 126 located along the axis 118. The guide member 122 also includes a plurality of peripheral apertures 128 located adjacent each central aperture 126, such as four peripheral apertures 128 located in a generally square or rectangular pattern about a respective central aperture 126. The guide member 122 also includes a plurality of elongate generally rectangular slots 130, with a respective slot 130 being associated with each central aperture 126. Each slot 130 extends generally transversely to the axis 118.

Figure 8:
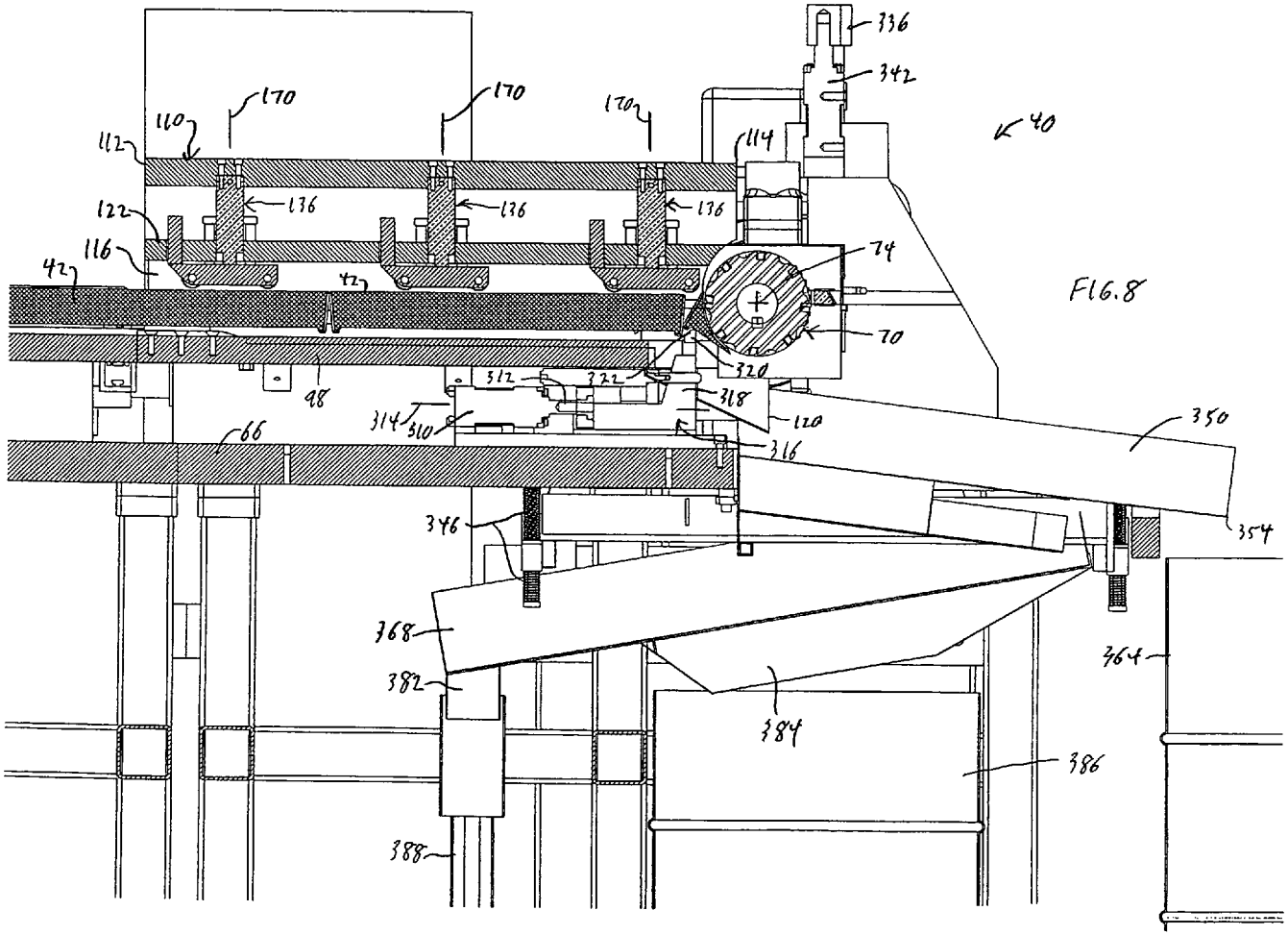
FIG. 8 is a cross sectional view taken along line 8-8 of FIG. 2.
Figure 9:
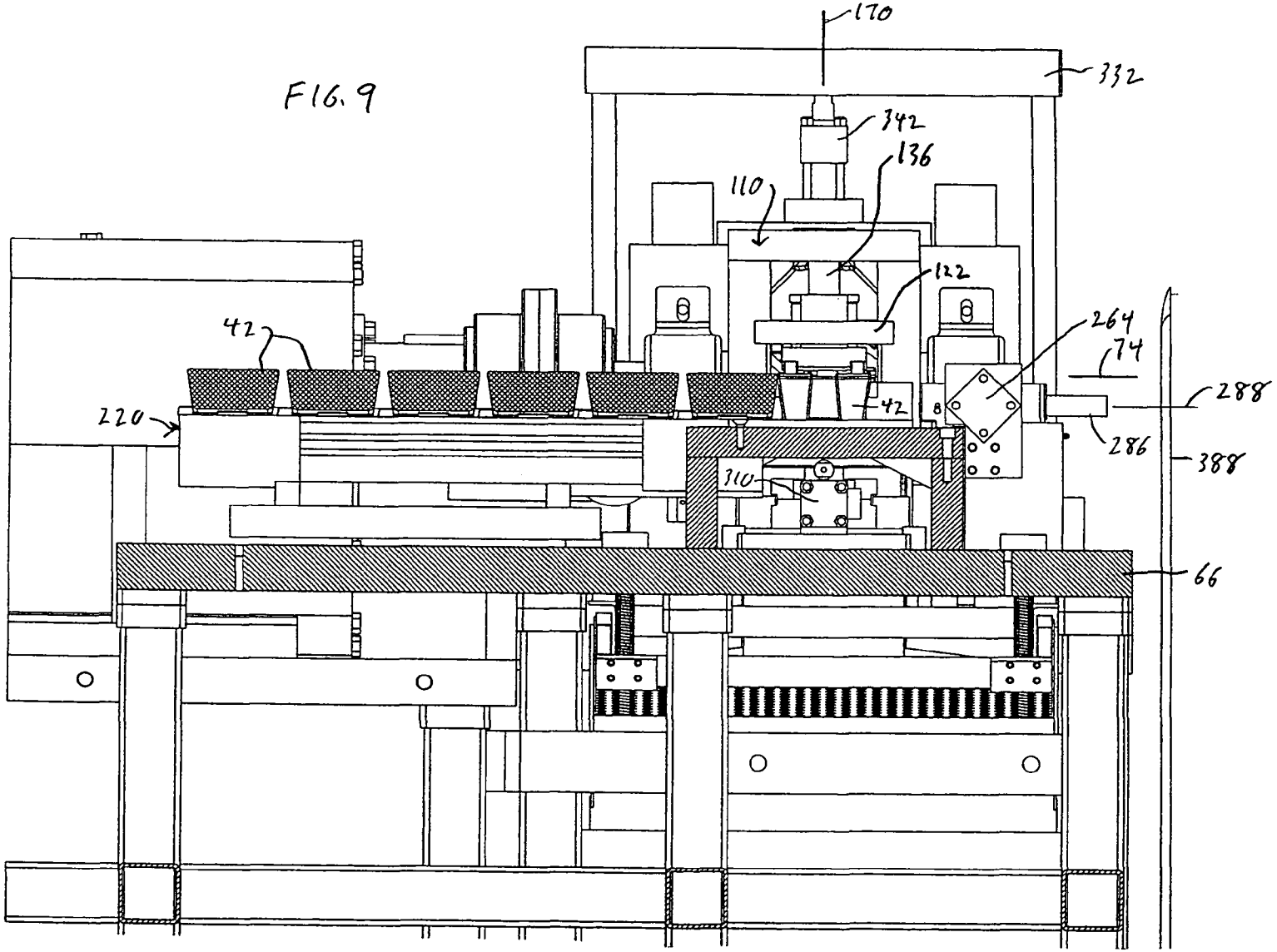
FIG. 9 is a cross sectional view taken along line 9-9 of FIG. 2.
Figure 10:
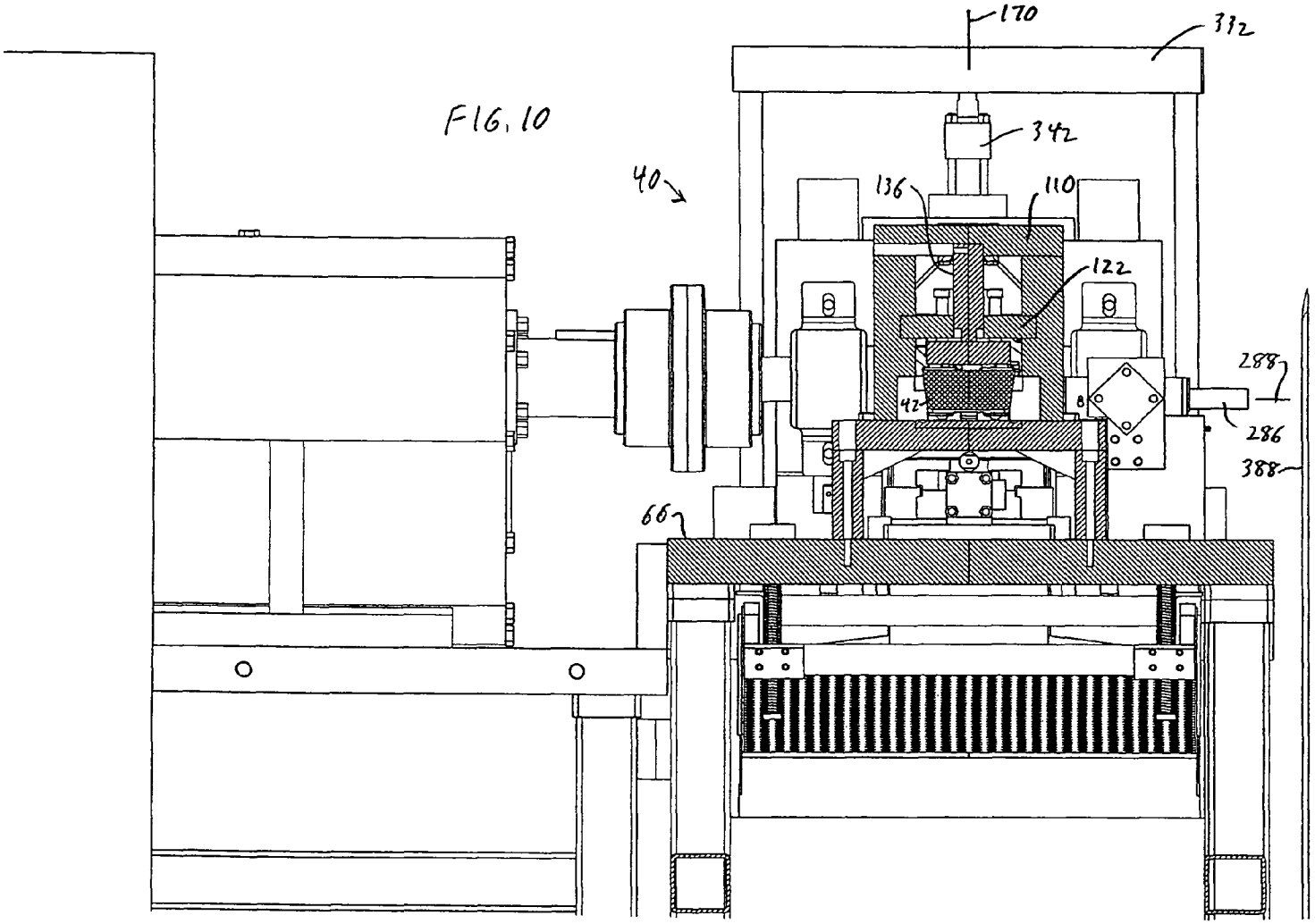
FIG. 10 is a cross sectional view taken along line 10-10 of FIG. 2.

The guide mechanism 90 may also include one or more hold-down mechanisms 136. As shown in FIG. 8, the chute 110 includes three hold-down mechanisms 136, but additional or fewer hold-down mechanisms 136 may be used. As shown in FIGS. 17-22, each hold-down mechanism 136 includes an engagement member 138 adapted to engage the ingots 42. The engagement member 138 includes a first end 140 and a second end 142. The engagement member 138 is in the general form of a plate wherein the first end 140 includes a slanted or inclined end wall. A plurality of rotatable rollers or wheels 144 are rotatably attached to the engagement member 138. One pair of rollers 144 are rotatable about a first axis 146, and a second pair of rollers 144 are rotatable about a second axis 148 that is substantially parallel to the first axis 146. The rollers 144 extend downwardly beyond the bottom surface of the engagement member 138 such that the rollers 144 are adapted to rotatably engage the top wall 50 of the ingots 42. The axes 146 and 148 extend generally transversely to the axis 118 of the passageway 116 and parallel to the axis 74. The engagement members 138 are adapted to engage the ingots 42 through the wheels 144.

Each hold-down mechanism 136 also includes one or more guide posts 152. The hold-down mechanism 136 as shown in the drawing figures includes four guide-posts 152 arranged in a generally rectangular pattern, although fewer or additional guide-posts may be used. Each guide post 152 extends generally transversely and upwardly from the top surface of the engagement member 138. The upper end of each guide post 152 includes a head 154 that is larger in diameter than the body of the guide post 152. The body of each guide post 152 is adapted to extend through a respective peripheral aperture 128 in the guide member 122 of the chute 110. The body of the guide post 152 is adapted to slide within the aperture 128 along an axis 156 of the guide-post 152, such that the guide post 152 is movable vertically upwardly and downwardly with respect to the guide member 122 and bottom wall 98. The head 154 is adapted to engage the guide member 122 to retain the body of the guide post 152 within the aperture 128. Each hold-down mechanism 136 also includes a guide bar 158 that extends upwardly from the top surface of the engagement member 138 adjacent the first end 140. The guide bar 158 is adapted to be vertically slidable within a slot 130 of the guide member 122. The guide posts 152 and guide bar 158 are adapted to inhibit movement of the engagement member 138 with respect to the guide member 122 in a generally horizontal direction, including generally parallel to the axis 118 and transversely thereto, while allowing generally vertical upward and downward movement of the engagement member 138 generally transversely to the axis 118 and parallel to the axes 156.

Each hold-down mechanism 136 also includes a biasing mechanism 164. The biasing mechanism 164 may comprise a spring, such as a pressurized nitrogen spring, including a housing 166 and an extendable and retractable piston 168. The nitrogen spring may, for example, be a Tanker Model T2-750 nitrogen spring with a two inch stroke. The piston 168 is movable along an axis 170 that is generally vertical and parallel to the axes 156, and perpendicular to the axis 118 of the passageway 116 and axis 74 of the cutter head 70. The top end of the housing 166 is attached to the inside surface of the top wall 106 of the chute 110 and the housing 166 extends downwardly through a central aperture 126 in the guide member 122. A bottom outer end of the piston 168 applies force to the top surface of the engagement member 138. The biasing mechanism 164 is adapted to provide a biasing force to the engagement member 138 in a direction generally parallel to the axis 170 and transversely to the axis 118, such that the engagement member 138 is resiliently biased away from the guide member 122 and toward the bottom wall 98 of the chute 110. The biasing mechanism 164 may comprise a mechanical spring such as a helical spring, and may be attached to the guide member 122 if desired. The hold-down mechanisms 136 are spaced apart from one another along the axis 118 of the passageway 116. The hold-down mechanisms 136, as shown in FIG. 8, are spaced apart from one another such that two or more hold-down mechanisms 136 can simultaneously engage the same ingot 42.

The base member 98 of the base 92 of the guide mechanism 90 extends between a first end 190 and a second end 192 located adjacent the cutter head 70. A guide rail 194 is attached to the base member 98 and extends from adjacent the first end 190 of the base member 98 to adjacent the first end 112 of the chute 110. The guide rail 194 is located generally parallel to and in alignment with the first side wall 102 of the chute 110. The base member 98 includes a load area 196 that extends approximately from adjacent the first end 190 of the base member 98 to approximately the first end 112 of the chute 110, generally adjacent to the guide rail 194 and along the axis 118. The load area 196 is in communication with the opening of the passageway 116 at the first end 112 of the chute 110 and is adapted to sequentially receive, one after another, a plurality of ingots 42 for feeding into the passageway 116.

The chipper device 40 also includes a feed mechanism 200. The feed mechanism 200 is located adjacent to the first end 190 of the base member 98 of the guide mechanism 90, and may be connected to the platform 66. The feed mechanism 200 includes an actuator member such as a fluid cylinder 202. The fluid cylinder 202 may comprise a hydraulic cylinder. The fluid cylinder 202 includes a housing 204 and a selectively extendable and retractable ram 206. The ram 206 extends outwardly from the housing 204 to an outer end 208. The ram 206 and the outer end 208 are adapted to move between an extended position and a retracted position along a generally linear axis 210 that is generally parallel to the axis 118 of the passageway 116. When the ram 206 is in the retracted position, the outer end 208 is located adjacent the first end 190 of the base 92, and when the ram 206 is located in the extended position the outer end 208 is located adjacent the first end 112 of the chute 110. The outer end 208 of the ram 206 crosses over the load area 196 as it moves between its extended and retracted positions. The feed mechanism 200 is connected to a source of pressurized fluid and is connected to and controlled by the control panel 86.

The chipper device 40 also includes a loading mechanism 220. The loading mechanism 220 is located adjacent to the base member 98 of the base 92 adjacent the load area 196. The loading mechanism 220 may comprise a conveyor 221 including one or more rotatable endless belts 222. Each belt 222 extends between a rotatable head drive pulley and a rotatable tail pulley. Each belt 222 includes a plurality of spaced apart upstanding cleats 224. The belts 222 are adapted to be rotated by a motor 225 such that the upper runs of the belts 222 move generally parallel to a central axis 226 in a direction toward the load area 196 of the base member 98. The axis 226 is generally perpendicular to the axis 118 of the passageway 116 and the axis 210 of the feed mechanism 200. The belts 222 are parallel to one another and are spaced apart from one another in a direction generally transversely to the axis 226. Each belt 222 is adapted to receive a respective end 46 or 48 of an ingot 42. The cleats 224 on each belt 222 are spaced apart with respect to one another such that the end of an ingot 42 will fit closely between two adjacent cleats 224. The belts 222 are adapted to support one or more ingots 42 generally parallel to one another with the longitudinal axis 44 of the ingots 42 located generally perpendicular to the axis 226 of the loading mechanism 220 and parallel to the axis 118 of the passageway 116. The rotation of the belts 222 of the loading mechanism 220 moves the ingots 42 along the axis 226 and moves an ingot 42 onto the load area 196 of the base member 98. Rotational movement of the belts 222 is indexed such that rotation of the belts 222 is stopped when each ingot 42 is sequentially moved onto the load area 196. Rotation of the belts 222 is started after a first ingot 42 in the load area 196 is moved out of the load area 196 by the feed mechanism 200 such that the loading mechanism 220 may move a second ingot 42 onto the load area 196. Alternatively, the loading mechanism 220 may include additional rotational belts 222, or may include only a single rotational belt that is sufficiently wide to support the ingots 42. The motor 225 of the loading mechanism 220 is electrically connected to and controlled by the control panel 86.

Figure 23:
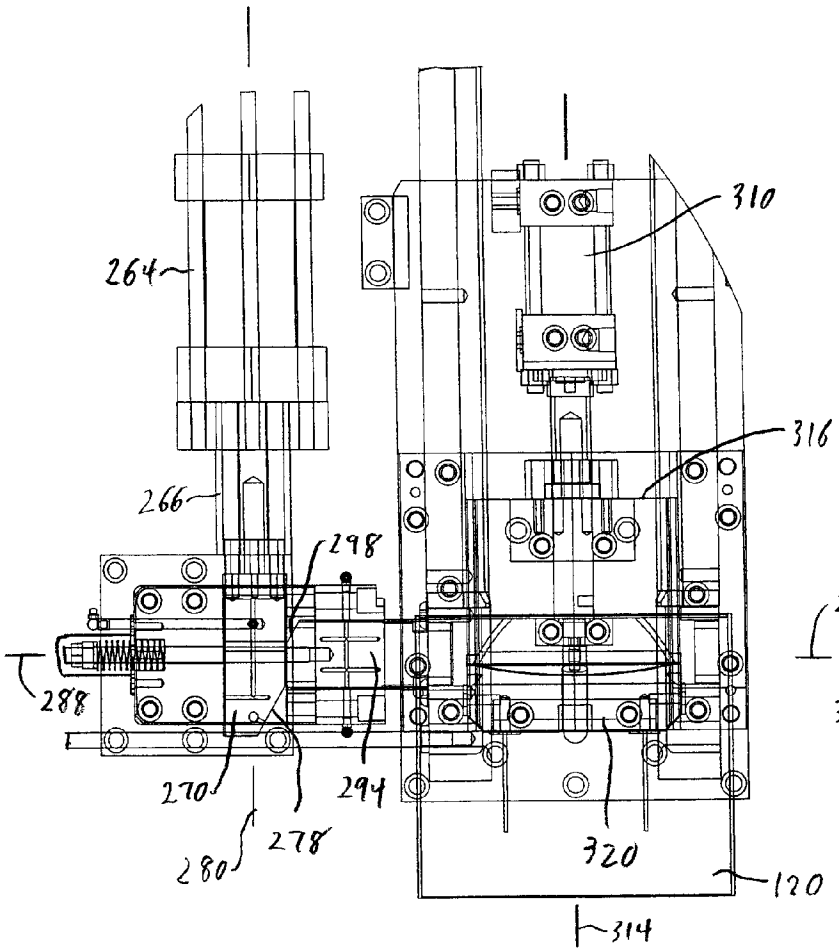
FIG. 23 is a top plan view of the unloader mechanism shown in the run position.
Figure 25:
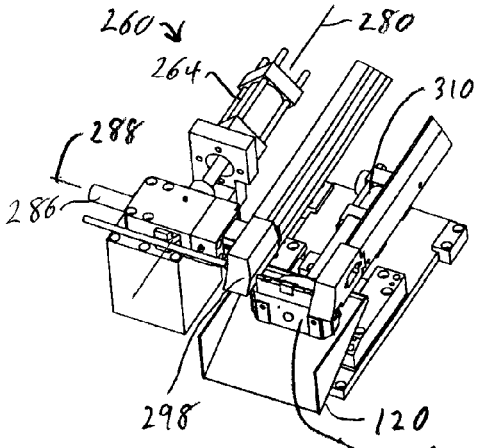
FIG. 25 is a perspective view of the unloading mechanism shown in the run position.
Figure 26:
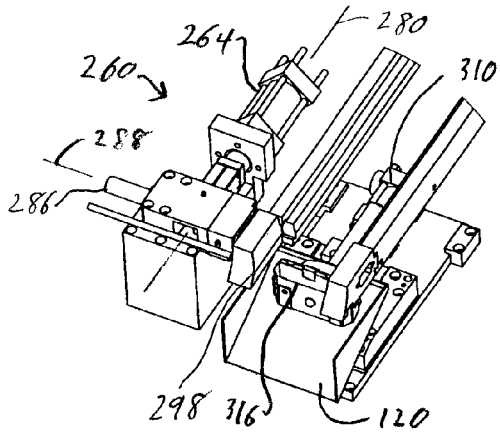
FIG. 26 is a perspective view of the unloading mechanism shown in the unload position.
Figure 30:
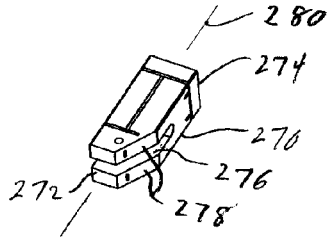
FIG. 30 is perspective view of the wedge member of the unloading mechanism.

The chipper device 40 may also include an unloader mechanism 260. The unloader mechanism 260 is located generally adjacent the second end 114 of the chute 110. The unloader mechanism 260 includes a base 262 attached to the platform 66. An actuator member 264, such as a hydraulic cylinder, having a selectively extendable and retractable ram 266 is connected to the base 262 by a mounting member 268. The mounting member 268 includes an aperture through which the ram 266 is adapted to extend. A wedge member 270, as shown in FIG. 30, includes a first end 272 and a second end 274. The second end 274 is connected to the outer end of the ram 266 of the actuator member 264. The first end 272 of the wedge member 270 includes an open-end generally horizontal slot 276 formed between upper and lower fingers. The first end 272 also includes a ramped wall 278 on each finger that is generally planar and that is disposed at an angle to the central axis 280 of the ram 266 and wedge member 270. The wedge member 270 is slidably located within a bore of a guide member 282 that extends along the axis 280. The guide member 282 is connected to the base 262. The actuator member 264 is adapted to selectively slide the wedge member 270 along the axis 280 between an extended or run position as shown in FIGS. 23 and 25, and a retracted or unload position as shown in FIGS. 24 and 26.

Figure 27:
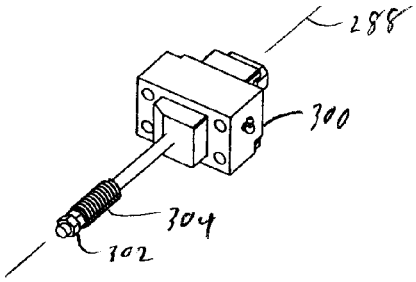
FIG. 27 is a perspective view of the engagement member of the unloading mechanism shown in the run position with respect to the guide member.
Figure 28:
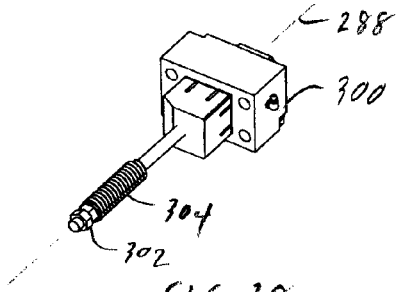
FIG. 28 is a perspective view of the engagement member of the unloading mechanism shown in the unload position with respect to the guide member.
Figure 29:
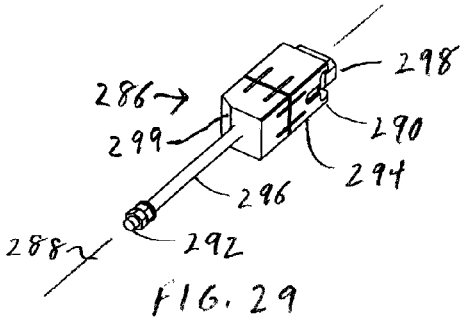
FIG. 29 is a perspective view of the engagement member of the unloading mechanism.

The unloader mechanism 260 also includes an ingot engagement member 286 having a central axis 288 that extends between a first end 290 and a second end 292. The engagement member 286 includes a head 294 at the first end 290 and a shaft 296 that extends from the head 294 to the second end 292. The head 294 includes a tip 298 that is adapted to selectively engage the first side wall 54 of an ingot 42 that is in engagement with the cutter head 70. As shown in FIGS. 27 and 28, the head 294 of the engagement member 286 is adapted to be slidably located within a bore of a guide member 300 that is connected to the guide member 282. The bore of the guide member 300 is located generally perpendicular to the bore of the guide member 282 and the bores are in communication with one another through a transverse bore in the guide member 282 which is adapted to receive the shaft 296 of the engagement member 286. The engagement member 286 is selectively slidable along the axis 288 between an extended or run position as shown in FIGS. 23, 25 and 27 and a retracted or unload position as shown in FIGS. 24, 26 and 28. The shaft 296 of the engagement member 286 is located in the slot 276 between the fingers of the wedge member 270. An abutment member 302 such as a threaded nut is threadably attached to the shaft 296 at the second end 292. A resilient biasing member 304, such as helical coil spring, extends around the shaft 296 with one end in engagement with the abutment member 302 and an opposite end in engagement with the guide member 282. The biasing member 304 is adapted to resiliently bias the engagement member 286 from the extended position toward the retracted position of the engagement member 286 along the axis 288. The head 294 of the engagement member 286 includes a ramped wall 299 at the opposite end from the tip 298 that is located at an angle to the axis 288. The ramped wall 299 is adapted to selectively matingly engage the ramped walls 278 of the wedge member 270.

Figure 24:
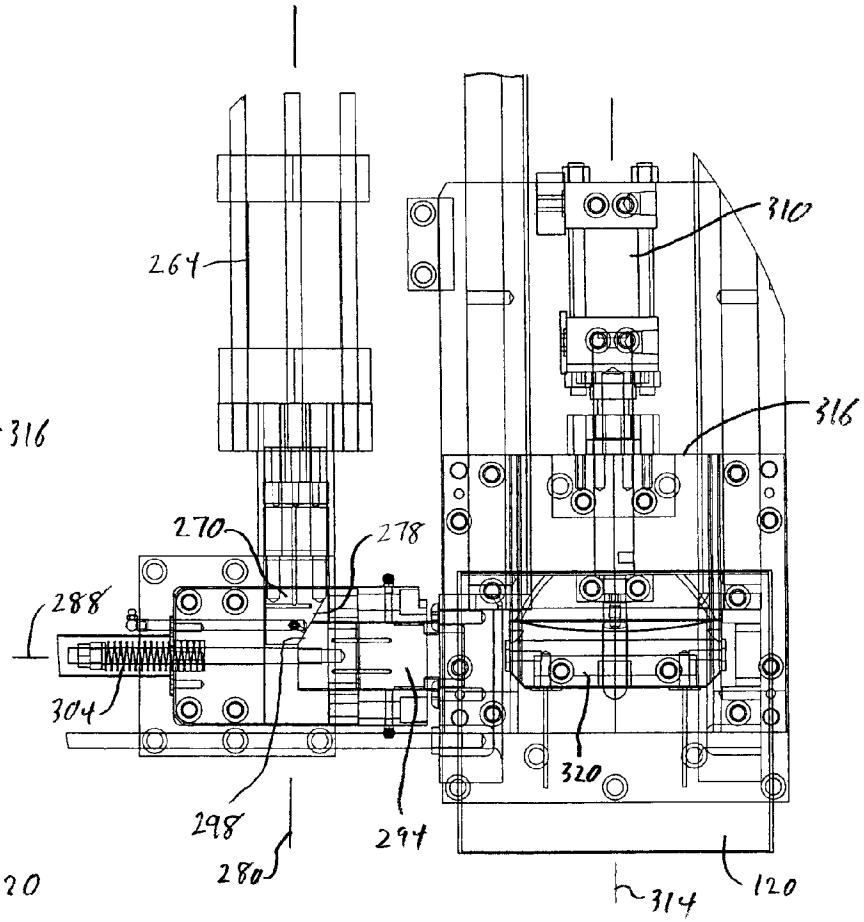
FIG. 24 is a top plan view of the unloader mechanism shown in the unload position.

When the actuator member 264 retracts the ram 266 and wedge member 270 along the axis 280, the wedge member 270 allows the engagement member 286 to linearly slide along the axis 288 from its extended position to its retracted position as shown in FIG. 24 in response to the biasing force provided by the biasing member 304. When the engagement member 286 is located in the retracted position, the tip 298 of the head 294 is disengaged from the ingot 42 within the passageway 116 such that the tail end of ingot 42 that is being chipped by the cutter head 70 may be ejected into the collection member 120. After the tail end of the ingot 42 that was being chipped has been ejected, the actuator member 264 extends the ram 266 and wedge member 270 along the axis 280 to their extended positions. As the wedge member 270 linearly slides from its retracted position toward its extended position, the ramped wall 278 of the wedge member 270 engages the ramped wall 299 of the head 294 of the engagement member 286. As the wedge member 270 continues to slide toward its extended position, the wedge member 270 slides the engagement member 286 along the axis 288 from the engagement member retracted position toward the engagement member extended position as shown in FIG. 23. Once the wedge member 270 and engagement member 286 are in their extended positions, the wedge member 270 prevents the engagement member 286 from moving toward the retracted position of the engagement member 286. When the engagement member 286 is in its extended position, the head 294 of the engagement member 286 extends through a recess formed by the side wall 102 into the passageway 116 such that the tip 298 may engage the ingot 42 that is being chipped by the cutter head 70 to inhibit movement of the ingot 42 other than along the axis 118 of the passageway 116. The actuation of the actuator member 264 is controlled by the sensed position of the ram 206 of the actuator member 202 of the feed mechanism 200.

The unloader mechanism 260 may also include an actuator member 310, such as a hydraulic cylinder, having a ram 312 that is selectively linearly extendable and retractable along an axis 314 that is parallel to and spaced apart from the axis 118 of the passageway 116. A slidable support member 316 is located at the end of the base member 98 adjacent the cutter head 70 and is slidably attached to the platform 66. The support member 316 includes an upwardly extending leg 318 having a tip 320 with an inclined surface 322. The tip 320 extends above the base member 98 into the passageway 116. The collection member 120 may be attached to the support member 316. The actuator member 310 is adapted to selectively slide the support member 316 parallel to the axis 118 between an extended position wherein the tip 320 is located adjacent to and at a first distance from the cutter head 70, and a retracted position wherein the tip 320 is spaced apart from the cutter head 70 at a second distance which is longer than the first distance. When the support member 316 is in the extended position, the tip 320 supports the ingot 42 that is being chipped by the cutter head 70. When the support member 316 is slid to its retracted position, the tip 320 is moved away from the cutter head 70 to create an enlarged opening between the tip 320 and the cutter head 70 through which the tail end of the ingot 42 that is being chipped may pass into the collection member 120. After the tail end of the ingot 42 is ejected into the collection member 120, the actuator member 310 slides the support member 316 to its extended position wherein the tip 320 will support the following ingot 42 during engagement with the cutter head 70. The actuator member 310 is operated by the sensed position of the ram 206 of the feed mechanism 200.

Figure 31:
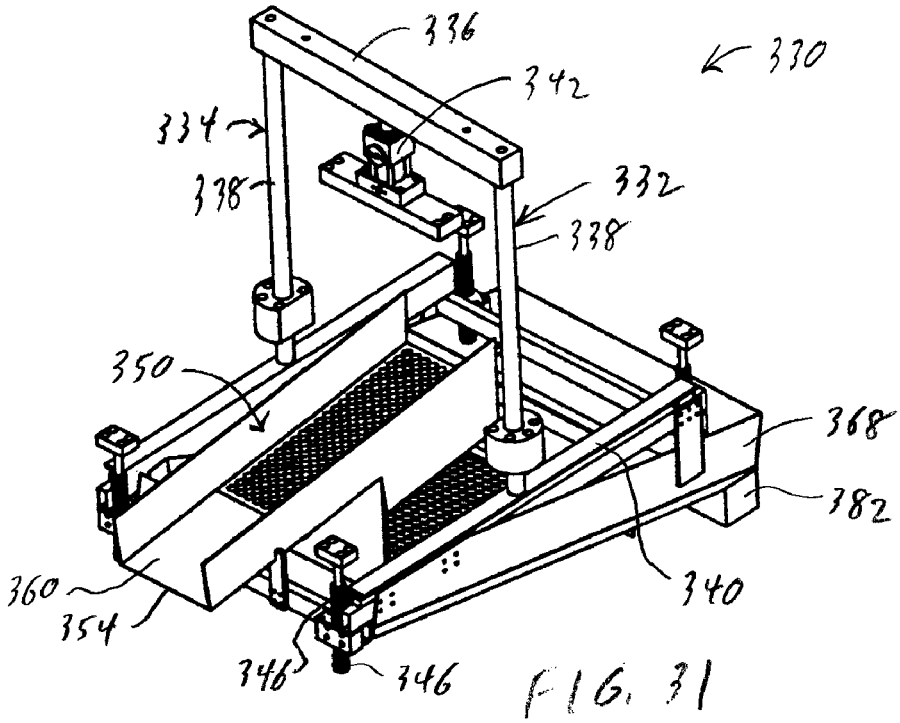
FIG. 31 is a top perspective view of the sifting mechanism.
Figure 32:
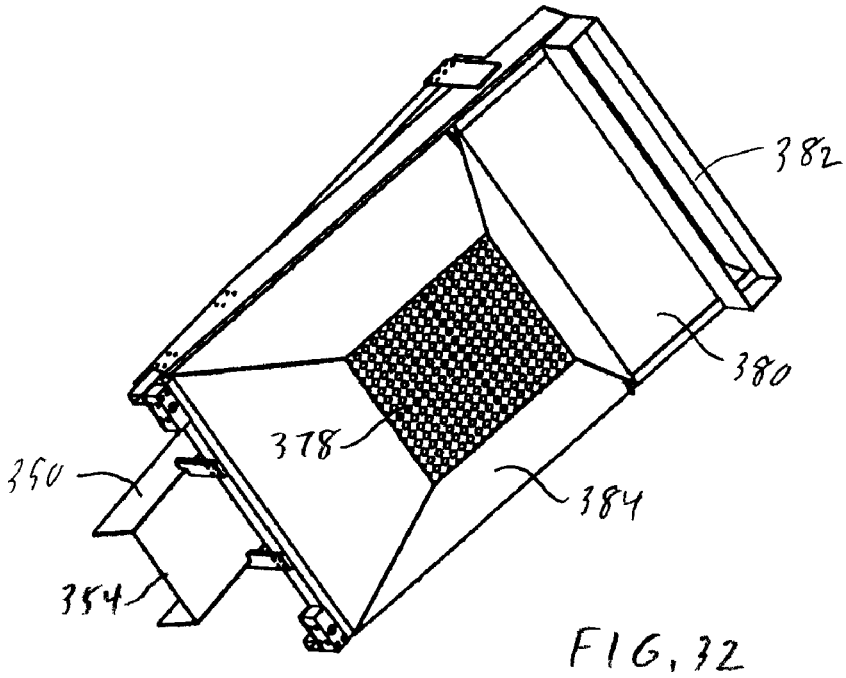
FIG. 32 is a bottom perspective view of the sifting mechanism.
Figure 33:
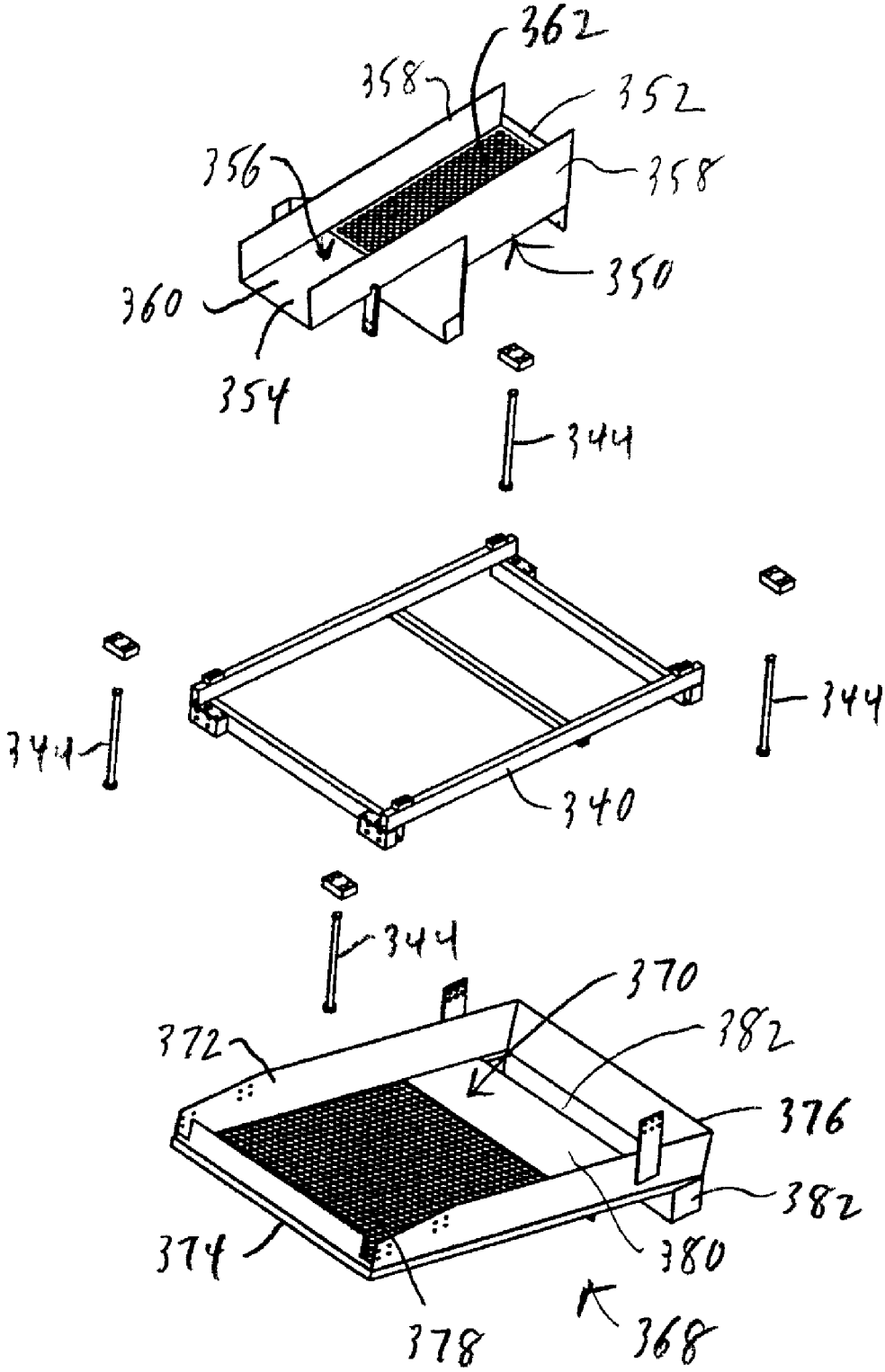
FIG. 33 is a partial exploded view of the sifting mechanism.

The chipper device 40 may also include a sifting mechanism 330 such as shown in FIG. 31. The sifting mechanism 330 includes a frame 332. The frame 332 includes an upper frame 334 having a cross bar 336 and downwardly extending posts 338 at each end of the cross bar 336. The bottom ends of the posts 338 are connected to a lower frame 340 of the frame 332. The cross bar 336 of the upper frame 334 is connected to a vibrator 342, such as a hydraulic linear vibrator. The lower frame 340 is generally rectangular, and each corner is resiliently connected to the platform 66 by respective posts 344 having upper and lower resilient biasing members 346, such as helical coil springs. The sifting mechanism 330 includes a first upper sifter 350 attached to the lower frame 340. The upper sifter 350 includes a first end 352 and a second discharge end 354. The upper sift 350 is generally trough or U-shaped having a bottom wall 356 and parallel upwardly extending side walls 358. The first end 352 is adapted to be located adjacent the collection member 120 such that the upper sifter 350 is adapted to receive ingot particles and material that passes through the passageway 116. The bottom wall 356 of the upper sifter 350 is inclined or sloped downwardly from the first end 352 toward the second end 354, such that the first end 352 is higher than the second end 354. The bottom wall 356 includes a solid wall portion 360 at the second end 354. The bottom wall 356 also includes a screen 362 having a plurality of apertures that is adapted to receive ingot particles and material from the collection member 120. The screen portion 362 extends from the solid bottom wall portion 360 to the first end 352. The apertures in the screen portion 362 of the upper sifting mechanism 350 may have a diameter of approximately 0.1875 inches. Ingot particles and material received in the upper sifter 350 that are smaller than the apertures in the screen 362 will pass through the screen 362. Ingot particles and material that is received in the upper sifter 350 that are larger than the apertures in the screen 362 will move downwardly along the bottom wall 356, due to the vibration of the sifting mechanism 330, to the solid portion 360 of the bottom wall 356 and will be discharged through the second end 354 of the upper sifter 350 into a large particle container 364 located below the second end 354 of the upper sifter 350.

The sifting mechanism 330 also includes a lower sifter 368 attached to the lower frame 340. The lower sifter 368 includes a bottom wall 370 and an upwardly extending peripheral side wall 372. The lower sifter 368 extends between a first end 374 and a second end 376. The bottom wall 370 is sloped or inclined downwardly from the first end 374 to the second end 376, such that the first end 374 is higher than the second end 376. The bottom wall 370 includes a screen 378 that extends from the first end 374 to a solid bottom wall 380. The screen 378 includes a plurality of apertures, which may have a diameter such as approximately 0.045 inches or 0.062 inches as may be desired. The first end 374 of the lower sifting mechanism 368 includes a receptacle 382 that is in communication with the solid bottom wall portion 380. A funnel 384 is located below the screen 378.

Ingot particles that pass through the screen 362 of the upper sifter 358 are received on the screen 378 of the lower sifter 368. Ingot particles that are smaller than the apertures in the screen 378 of the lower sifter 368 will pass through the screen 378 and funnel 384 into a small particle receptacle 386. Ingot particles that are larger than the apertures in the screen 378 will move downwardly along the bottom wall 370 to the solid wall portion 380 and then into the receptacle 382. These medium size ingot particles will pass through an opening in the receptacle 382 into a conduit 388 for dispensing into a medium size particle receptacle 390. The conduit 388 may be vacuum operated to provide movement of the ingot particles through the conduit 388. The medium size ingot particles in the receptacle 390 may be used in the Thixomolding process. The large and small size ingot particles and material in the receptacles 364 and 386 may be used for other processes. The vibrator 342 provides vibratory movement of the sifters 350 and 368 along a line of generally vertical and linear stroke to provide movement of ingot particles and material through the sifting mechanism 330.

The chipper device 40 may also include one or more sensors electrically connected to the control panel 86 for controlling operation of the chipper device 40. The chipper device 40 may include an ingot height sensor 240. The ingot height sensor 240 is located above the conveyor 220 and the ingots 42 that are loaded onto the conveyor 221. The ingot height sensor 240 determines whether an ingot is too tall or too short to be fed through the chute 1110. An error light on the control panel 86 will notify an operator to remove an ingot from the conveyor 221 that is outside of operational specifications.

The chipper device 40 may include an ingot present sensor 242 that is electrically connected to the control panel 86. The ingot present sensor 242 confirms that the ingots 42 are loaded correctly onto the conveyor 221. A light curtain 244 may be provided to prevent operation of the conveyor 221 until the operator is clear of the ingot loading area above the conveyor 221. If the light curtain is broken while the conveyor 221 is operating, the conveyor 221 will automatically stop.

A ram full extend sensor 246 may be associated with the actuator member 202 of the feed mechanism 200 to detect when the ram 206 of the feed mechanism 200 is fully extended. A ram full retract sensor 248 may be associated with the actuator member 202 to detect when the ram 206 is fully retracted such that the loading mechanism 220 may load an ingot 42 onto the load area 196. A feed speed sensor 250 may be associated with the load area 196 to determine the speed, such as in feet per minute (fpm), at which an ingot 42 is being fed toward the cutter head 70 by the feed mechanism 200.

One or more chip flow sensors 252 are located adjacent the cutter head 70 and the collection member 120 for detecting the flow of chipped particles through the collection member 120 and for detecting blockage of chipped particles in the collection member 120. The chip flow sensors 252 are connected to the control panel 86 and will stop operation of the chipper device 40 if a blockage of flow of chipped particles is sensed.

Magnesium burns with a bright intensity. A lumen sensor 254 and a temperature sensor 255 may be located adjacent the cutter head 70 and the collection member to detect whether there is a fire in a the collection member 120. The lumen sensor 254 and temperature sensor 255 are electrically connected to the control panel 86 and are adapted to stop operation of the chipper device 40 if a fire is detected. The lumen sensor 254 and the temperature sensor 255 will activate a fire prevention system, including an inert gas such as argon, for the suppression of the fire. The chipper device 40 may also include a conveyor index sensor 256 associated with the loading mechanism 220 adjacent the load area 196. The conveyor index sensor 256 may be located under the conveyor 221 to determine the correct location of the indexing ingot on the conveyor 221 with respect to the load area 196.

The chipper device 40 may also include various guard sensors which determine whether a piece of guarding of the chipper device 40 has been removed or left open. The guard sensors are connected to the control panel 86 and will prevent operation of the chipper device 40 unless all guard pieces are sensed to be secured in their proper place.

An operator manually loads one or more ingots 42 onto the belts 222 of the conveyor 221. The conveyor 221 moves the ingots 42 along the axis 226 and slides a first ingot 42 onto the load area 196 of the base member 98 such that the loaded ingot 42 is located adjacent the guide rail 194. Once an ingot 42 is located in the load area 196 operation of the conveyor 221 is stopped.

The ram 206 of the actuator member 202 is then extended from its retracted position toward its extended position wherein the outer end 208 of the ram 206 will engage the second end 48 of the first ingot 42 in the load area 196. As the ram 206 moves from its retracted position toward its extended position, the ram 206 moves the first ingot 42 over the base member 98 and along the axis 118 toward the opening in the first end 112 of the chute 110. When the ram 206 is in its fully extended position, the ram 206 will have slid the first ingot 42 into the passageway 116 of the chute 110 such that the second end 48 of the first ingot 42 is located beyond the first ends 46 of the ingots 42 on the conveyor 221. The ram 206 is then retracted to its retracted position wherein the full retract sensor 248 will activate the conveyor 221 to move a second ingot 42 along the axis 226 onto the load area 196. The ram 206 of the feed mechanism 200 is then again moved from its retracted position to its fully extended position such that the second ingot 42 is moved along the axis 118 into the passageway 116 of the chute 110. As the second ingot 42 is moved along the axis 118 toward the cutter head 70, the first end 46 of the second ingot 42 will engage the second end 48 of the first ingot 42 such that the ram 206 will move both the first and second ingots 42 along the axis 118, through the passageway 116, and toward the cutter head 70 such that the first ingot 42 will engage the rotating cutter head 70. The ram 206 of the feed mechanism 200 moves the ingots along the axis 118 and through the passageway 116 into engagement with the rotating cutter head 70 at a desired rate of speed, such as for example, approximately 19.2 feet per minute. The actuator member 202 forces the ingots 42 into engagement with the rotating cutter head 70 with a desired amount of force. The ingot feed speed and the rotational speed of the cutter head 70 are factors that determine the geometry of the particles that are chipped from the ingots.

As the ingots 42 are fed through the passageway 116 of the chute 110, the engagement members 138 and rollers 144 of the hold-down mechanisms 136 engage the top surfaces 50 of the ingots 42 within the passageway 116. The biasing mechanisms 164 of the hold-down mechanisms 136 apply a downward biasing force to press the ingots 42 into engagement with the bottom wall 98 of the chute 110. The hold-down mechanisms 136 prevent the ingots 42 from moving upwardly and disengaging the bottom wall 98 as the ingots 42 move along the axis 118 through the passageway 116 and into engagement with the cutter head 70. The hold-down mechanisms 164 inhibit upward movement of the ingots 42 which may be caused by engagement with the cutter head 70, or by a following ingot trying to ride up above a lead ingot. The biasing mechanisms 164 of the hold-down mechanisms 136 enable the engagement members 138 to accommodate a small variance in ingot height. The chute 110 may include replaceable wear bars on each side wall 102 and 104 that may be changed as desired to allow different configurations of ingots to be used. The side walls 102 and 104 of the chute 110 and the guide bars guide the ingots 42 along the axis 118 into engagement with the cutter head 70.

The rotating cutter head 70 cuts or chips a plurality of chips or particles from each ingot 42 as the ingot 42 is fed into engagement with the rotating cutter head 70. The particles chipped from an ingot 42 flow into the collection member 120, and through the collection member 120 into the sifting mechanism 330

The control panel 86 provides the operator with the option of operating the chipper device 40 manually or automatically. The control panel 86 also provides the operator with operating information, such as the revolutions per minute of the cutter head 70, amperage draw of the drive motor 84, the total number of ingots chipped, hydraulic status of the feed mechanism 200, fire protection status, and the status of other sensor readings. The control panel 86 may also include an emergency stop button to stop all operation of the chipper device 40, and a button to manually activate the fire suppression system.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A chipper device for chipping one or more ingots, said chipper device comprising:

a cutter head adapted to be rotated about a first axis;

a guide mechanism associated with said cutter head, said guide mechanism including a chute having a first end, a second end, and a passageway having a second axis, said passageway extending from said first end toward said cutter head such that ingots are adapted to move through said passageway from said first end of said chute toward said cutter head, said guide mechanism including a hold-down mechanism having a first engagement member and a biasing member adapted to bias said first engagement member into engagement with an ingot in a direction generally transverse to said second axis while allowing the ingot to move parallel to said second axis; and a feed mechanism adapted to move one or more ingots through said passageway of said chute into engagement with said cutter head;

whereby said cutter head is adapted to chip an ingot into a plurality of particles, and said hold-down mechanism is adapted to inhibit vertical movement of the ingot as the ingot is being chipped by said cutter head.

2. The chipper device of claim 1 wherein said chute of said guide mechanism includes a bottom wall, a top wall, a first side wall and a second side wall.

3. The chipper device of claim 2 wherein said biasing mechanism is coupled to said top wall of said chute and is adapted to bias said first engagement member toward said bottom wall of said chute.

4. The chipper device of claim 3 wherein said guide mechanism includes a guide member extending between said first and second walls of said chute and located between said bottom wall and said top wall of said chute, said first engagement member being located between said guide member and said bottom wall of said chute.

5. The chipper device of claim 4 wherein said guide mechanism includes one or more guide posts attached to said first engagement member, said guide posts extending through said guide member such that said guide posts are slideable with respect to said guide member, said guide posts allowing vertical movement of said first engagement member with respect to said guide member and inhibiting horizontal movement of said first engagement member with respect to said guide member.

6. The chipper device of claim 1 wherein said first engagement member includes one or more rollers adapted to rollably engage an ingot as the ingot moves through the passageway of the chute.

7. The chipper device of claim 1 wherein said cutter head is located adjacent said second end of said chute.

8. The chipper device of claim 1 including a collection member adapted to receive particles chipped from an ingot by said cutter head, and one or more flow sensors associated with said collection member.

9. The chipper device of claim 1 wherein said feed mechanism comprises a fluid cylinder having a selectively extendable and retractable ram, said ram adapted to move one or more ingots through said passageway of said chute into sequential engagement with said cutter head.

10. The chipper device of claim 1 including a loading mechanism, said loading mechanism adapted to position one or more ingots in a load area with respect to said chute wherein said feed mechanism is adapted to move said ingot toward the cutter head.

11. The chipper device of claim 10 wherein said loading mechanism comprises a conveyor adapted to receive a plurality of ingots, said conveyor adapted to sequentially position the ingots in said load area with respect to said chute.

12. The chipper device of claim 10 including one or more sensors associated with said loading mechanism, said one or more sensors adapted to control operation of said loading mechanism.

13. The chipper device of claim 1 including an unloader mechanism located adjacent said cutter head, said unloader mechanism including a second engagement member selectively movable between an extended position wherein said engagement member is adapted to engage a side wall of an ingot and a retracted position wherein said second engagement member is disengaged from the ingot, said second engagement member being selectively movable from said retracted position to said extended position by an actuator member.

14. The chipper device of claim 13 wherein said unloader mechanism includes a resilient biasing member adapted to resiliently bias said second engagement member toward said retracted position.

15. The chipper device of claim 13 including a wedge member coupled to said actuator member, said actuator member adapted to move said wedge member between a retracted position and an extended position, said wedge member adapted to move said second engagement member from said retracted position of said second engagement member toward said extended position of said second engagement member.

16. The chipper device of claim 1 including an unloader mechanism located adjacent said cutter head, said unloader mechanism including a support member adapted to support an ingot that is in engagement with said cutter head, said support member being selective movable from an extended position wherein said support member is located a first distance from said cutter head toward a retracted position wherein said support member is located a second distance from said cutter head, said second distance being longer than said first distance.

17. The chipper device of claim 1 including a sifting mechanism adapted to receive ingot particles chipped by said cutter head, said sifting mechanism including a first sifter having a first screen and a first discharge end, wherein particles that do not pass through said first screen are discharged from said first sifter through said first discharge end.

18. The chipper device of claim 17 wherein said sifting mechanism includes a second sifter having a second screen and a second discharge end, said second screen adapted to receive particles that pass through said first screen of said first sifter, whereby particles that do not pass through said second screen are discharged through said second discharge end of said second sifter.

19. The chipper device of claim 18 wherein said sifting mechanism includes a vibrator adapted to vibrate said first and second sifters.

* * * * *